United States Patent [19]

Leptich et al.

[11] Patent Number: 5,014,656

[45] Date of Patent: May 14, 1991

[54] INTERNAL COMBUSTION ENGINE HAVING A PERMANENT GROUND ELECTRODE AND REPLACEABLE CENTER ELECTRODE ELEMENT

[75] Inventors: Joseph M. Leptich, Grand Blanc; Keith A. Penney, Davison; Steve F. Lowe, Drayton Plains, all of Mich.

[73] Assignee: General Motors Corporation, Detroit, Mich.

[21] Appl. No.: 513,498

[22] Filed: Apr. 25, 1990

[51] Int. Cl.[5] ..... H01T 13/08; H01T 13/32

[52] U.S. Cl. ..... 123/169 EL; 123/169 PA; 313/141; 445/7; 445/29

[58] Field of Search ..... 123/169 EL, 169 PA, 123/169 PH, 266, 268; 313/141, 143; 445/7, 29

[56] References Cited

U.S. PATENT DOCUMENTS

| | | | |
|---|---|---|---|
| 993,214 | 5/1911 | Winestock | 313/143 |
| 1,228,487 | 6/1917 | Sessions | 123/169 PB |
| 1,468,858 | 9/1923 | Curran | 313/143 |
| 2,038,042 | 4/1936 | Hansen | 123/169 |
| 2,252,636 | 8/1941 | Kohout et al. | 123/169 |
| 2,646,782 | 7/1953 | Fisher | 123/266 |
| 3,534,714 | 10/1970 | Urlaub | 123/32 |
| 4,007,714 | 2/1977 | Jones | 123/8.09 |
| 4,182,281 | 1/1980 | Heintzelman | 123/266 |
| 4,416,228 | 11/1983 | Benedikt et al. | 123/266 |
| 4,808,878 | 2/1989 | Kashiwara et al. | 313/141 |
| 4,924,829 | 5/1990 | Cheng et al. | 123/169 PA |
| 4,931,686 | 6/1990 | Oakley | 313/143 |

FOREIGN PATENT DOCUMENTS

| | | | |
|---|---|---|---|
| 1103080 | 3/1961 | Fed. Rep. of Germany | 123/169 PA |

*Primary Examiner*—Tony M. Argenbright
*Assistant Examiner*—Robert E. Mates
*Attorney, Agent, or Firm*—Douglas D. Fekete

[57] ABSTRACT

An internal combustion engine includes a cylinder head and a permanent ground electrode and replaceable center electrode element received in a cylinder head bore. The permanent ground electrode is affixed to the cylinder head at the inner wall thereof and protrudes into the combustion chamber. The ground electrode preferably has a cup-like configuration defining an electrode-receiving hollow in the combustion chamber in registry with the bore. The center electrode element comprises a center electrode and an insulator body having a shoulder for engaging a seat in the bore. The insulator body shoulder is clamped against the seat by an annular retainer nut. When the center electrode element is so clamped, the center electrode is received in the electrode-receiving hollow defined by the ground electrode in the combustion chamber so as to cooperate with the ground electrode in defining a spark gap therebetween.

11 Claims, 3 Drawing Sheets

INTERNAL COMBUSTION ENGINE HAVING A PERMANENT GROUND ELECTRODE AND REPLACEABLE CENTER ELECTRODE ELEMENT

FIELD OF THE INVENTION

The present invention relates to an internal combustion engine having a cylinder head comprising a permanent ground electrode and a replaceable spark plug center electrode element in a cylinder head bore.

BACKGROUND OF THE INVENTION

A typical spark plug comprises an insulator body enhousing a center electrode and a metal shell crimped about the insulator body. The shell is threaded for mounting the spark plug in a bore of a cylinder head of an internal combustion engine and also comprises a side electrode. The side electrode depends from the shell off-center from the center electrode. Because of this, it is necessary to size the bore not only to receive the center electrode but also to accommodate the side electrode. At the same time, there has been a trend toward downsizing the engine and to adding features, such as multiple valves and larger gas passages, that reduce the space available on the face of the cylinder head for the spark plug. Thus, there is a need for a spark plug that reduces the diameter of the spark plug bore in the cylinder head.

It is an object of this invention to provide a spark plug assembly for an internal combustion engine that includes a ground electrode that is permanently affixed to the cylinder head and a center electrode element replaceably mounted in the cylinder head and cooperating with the ground electrode to provide the necessary gap for generating a spark for engine operation. By eliminating the necessity to accommodate the ground electrode through the cylinder head, this invention allows the diameter of the cylinder head bore to be sized to a minimum necessary to accommodate the center electrode element.

SUMMARY OF THE INVENTION

The present invention contemplates an internal combustion engine having a cylinder head, a ground electrode permanently affixed to the cylinder head, and a spark plug center electrode element replaceably installed in a bore of the cylinder head. The cylinder head includes an outer wall and an inner wall, which inner wall forms a portion of a combustion cylinder. The bore extends between the outer and inner walls along an axis and includes an intermediate transverse seat facing the cylinder head outer wall.

The permanent ground electrode is attached to the cylinder head at the inner wall proximate the bore and protrudes beyond the cylinder head inner wall into the combustion chamber. The electrode is preferably formed of a nickel-base or other suitable refractory metal in contrast to the aluminum or iron casting that forms the cylinder head. As used herein, permanent electrode refers to an electrode that is attached to the cylinder head in a manner that prevents the electrode from being readily removed from the cylinder head. The electrode may be integrally bonded to the cylinder head so as not to be detached without damange to the cylinder head or, if detachable, may be attached in such a manner as to require disassembly of the cylinder head from the engine for access to the inner wall for removal, it being understood that disassembly of a cylinder head from an automotive engine is a formidable task readily contrasted to the simple task of unscrewing a conventional spark plug at the cylinder head outer wall. Preferably, the ground electrode is attached by press fitting the electrode into the bore of a preformed cylinder head or by casting metal about a preformed ground electrode element to capture the electrode as an insert within the cylinder head casting. The ground electrode preferably has a cup-like shape to define an electrode-receiving hollow in registration with the cylinder head bore and includes an opening for communication between the hollow and the combustion chamber.

The spark plug center electrode element is replaceably received in the cylinder head bore through the outer wall and comprises a center electrode surrounded by an insulator body and having an exposed spark tip. The insulator body includes a shoulder for engaging the bore seat. When the center electrode element is received in the bore, the insulator body shoulder engages the bore seat and the center tip electrode is received in the electrode-receiving hollow spaced apart from the ground electrode so as to cooperate therewith to define a spark gap. The insulator body shoulder is clamped against the bore seat by locking means cooperatively engaging the cylinder head and insulator body.

The present invention thus permits a spark plug assembly that is installed in a cylinder head bore having a smaller diameter at the outer wall than would otherwise be required for a conventional spark plug including a shell and dependent side electrode.

The invention also contemplates a method of manufacturing a ground electrode for use with a spark plug center electrode element installed in a cylinder head of an internal combustion engine. In accordance with a preferred method of the invention, a preferred cup-shaped ground electrode element includes a peripheral wall, a first, open end and a second, at least partially closed end that cooperate to define an open-ended center electrode-receiving hollow. A portion of the peripheral wall is permanently affixed in the cylinder head concentric with the bore in such a manner that the hollow registers with the bore and is accessible through the bore. The closed end protrudes beyond the cylinder head inner wall and is adapted to reside within the combustion chamber. A mandrel is axially inserted in the cylinder head bore through the cylinder head outer wall and includes a mandrel end or tip for engaging the closed end of the ground electrode. The ground electrode closed end is worked against the mandrel end to position the closed end in preselected axial relation to a cylinder head bore seat adapted to engage the spark plug center electrode element. The mandrel is then removed from the cylinder head bore. Upon installation of the center electrode element in the cylinder head bore, the ground electrode closed end will be in a desired axial relation to the center electrode.

The aforementioned objects and advantages of the present invention will become more readily apparent from the following detailed description taken with the drawings.

DETAILED DESCRIPTION OF THE INVENTION

Figure 1:
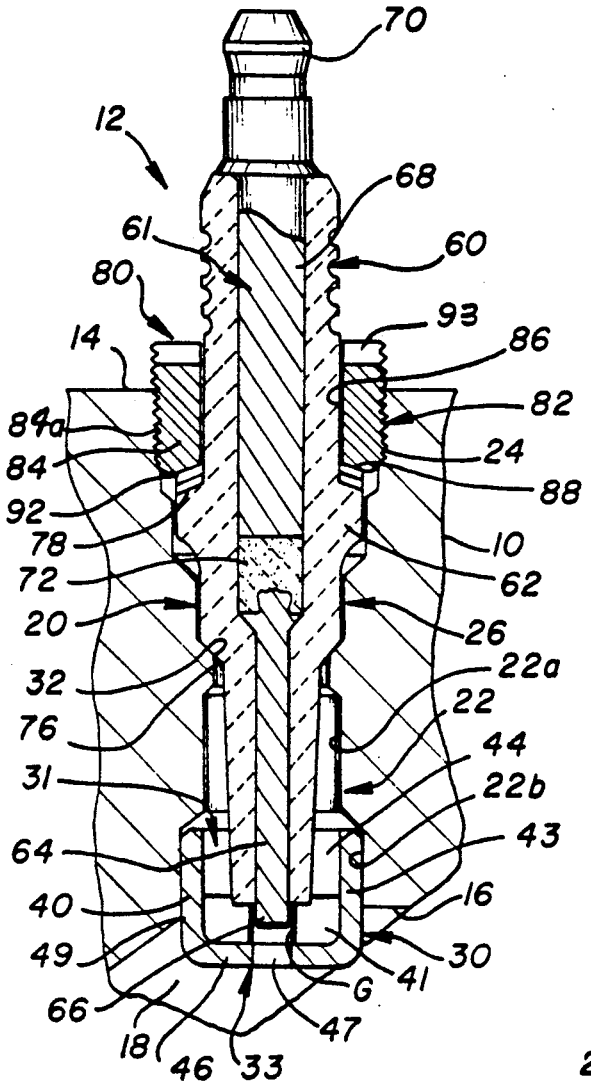
FIG. 1 is a longitudinal cross-sectional view of a portion of an internal combustion engine cylinder head having a permanent ground electrode and a replaceable spark plug center electrode element secured in the cylinder head bore in accordance with the invention.
Figure 2:
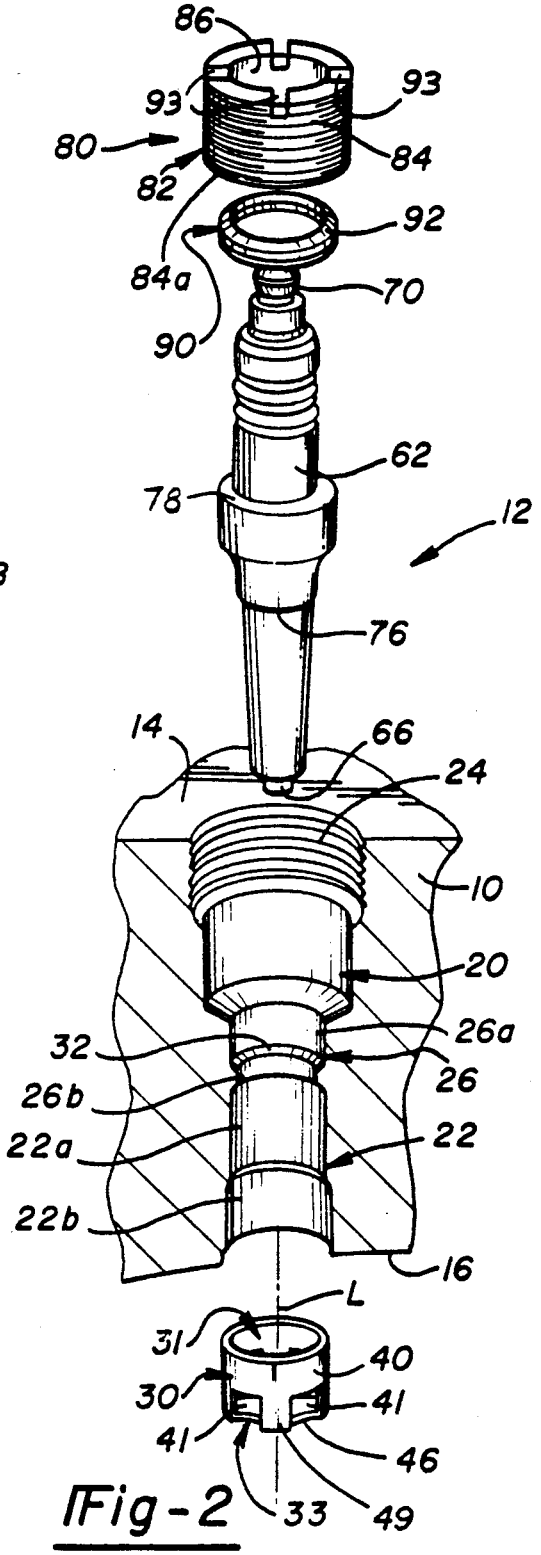
FIG. 2 is an exploded view of the components shown in FIG. 1.

In accordance with a preferred embodiment of this invention, a portion of a cylinder head 10 of an internal combustion engine 12 is shown in FIGS. 1 and 2. The cylinder head 10 comprises an outer wall 14 and an inner wall 16 and is attached to an engine block (not shown) such that the inner wall 16 forms an end wall of a cylindrical combustion chamber 18. The cylinder head 10 includes a spark plug bore 20 extending between the outer and inner walls 14,16 along a bore axis L.

The cylinder head bore 20 includes an inner, cylindrical bore 22 at the cylinder head inner wall 16, an outer, threaded, cylindrical bore 24 at the cylinder head outer wall 14 and an intermediate, cylindrical bore 26. The inner bore 22 includes a first bore portion **22*a* of a first diameter and a second enlarged bore portion 22*b* of a second diameter larger than the first diameter so as to receive a metal permanent ground electrode 30** to be described hereinbelow.

The intermediate bore 26 includes an annular seat 32 transverse of the bore axis L and facing the cylinder head outer wall 14. The annular seat 32 is formed between axially juxtaposed large diameter and smaller diameter bore portions **26*a*,26*b* as shown best in FIG. 2**.

In accordance with the present invention, the permanent ground electrode 30 includes an axially extending peripheral wall 40 partially received in the enlarged bore portion **22*b* of the inner bore 22 and affixed permanently to the cylinder head 10 in the bore portion 22*b* so as to be integral thereto. The peripheral wall 40 of the ground electrode 30 protrudes beyond the cylinder head inner wall 16 into the combustion chamber 18 and defines an axially elongated electrode-receiving hollow 44 in registration with the cylinder head bore 20, FIG. 1. The peripheral wall 40 terminates in the combustion chamber 18 in an end closure 46 extending transverse of the bore axis L. The ground electrode thus includes an open, outer end 31 in registration with the cylinder head bore 20 and an at least partially closed inner end 33**.

Figure 3:
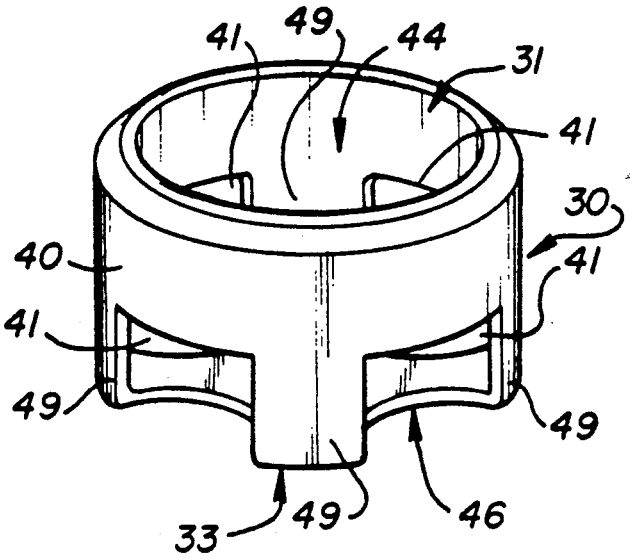
FIG. 3 is a perspective view of the ground electrode.
Figure 4:
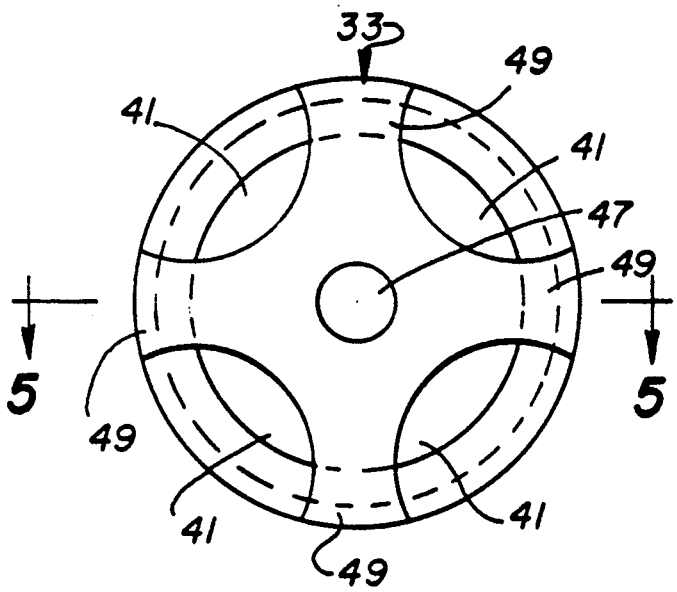
FIG. 4 is a bottom elevation of the ground electrode.
Figure 5:
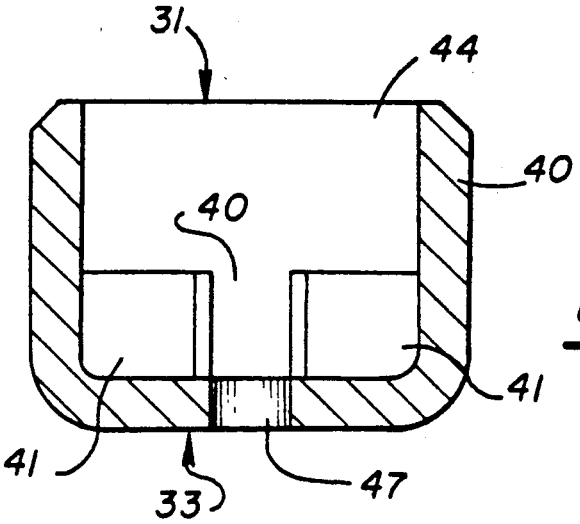
FIG. 5 is a cross-sectional view of the ground electrode taken along lines 5—5 of FIG. 4.

As shown best in FIGS. 3–5, the peripheral wall 40 includes circumferentially spaced apart apertures 41 while the end closure 46 includes a central, axial aperture 47. The apertures 41,47 are provided to place the electrode-receiving hollow 44 in communication with the combustion chamber 18 and to form circumferentially spaced apart electrode legs 49 on the ground electrode 30. As is apparent from FIGS. 1–5, the apertured peripheral wall 40 and end closure 46 impart a cage-like or cup-like configuration to the permanent ground electrode 30. The ground electrode 30 can be formed in this configuration by stamping, machining and other metal forming techniques.

As mentioned hereinabove, the ground electrode peripheral wall 40 is affixed permanently to the cylinder head 10 in the bore portion **22*b* so as to be integral with the cylinder head 10. In particular, an axial portion 43 of the ground electrode peripheral wall 40 can be press fit into the bore portion 22*b* to permanently affix it therein as shown in FIG. 1. Alternately, the cylinder head 10 may be cast in-situ about the axial portion 43 of the ground electrode peripheral wall 40 to integrally capture and permanently affix the ground electrode 30 in the bore portion 22*b*. In one alternate embodiment, ground electrode 30 may be suitably inserted into a corresponding bore of a vaporizable polystyrene foam pattern for incorporation into an aluminum casting by a lost foam casting process wherein the pattern, having a shape corresponding to the casting and including the ground electrode, is embedded into an unbonded sand and metal is cast into the mold to decompose and replace the pattern. Other techniques for permanently affixing the axial portion 43 of the peripheral wall 40 to the cylinder head 10** may include shrink fitting, screw threading and welding/brazing as well as other techniques.

One advantage of the invention is that ground electrode 30 is positioned in a predetermined angular relation to the bore axis L so as to place the apertures 41,47 and electrode legs 49 in predetermined orientation to the geometry of the combustion chamber 18 to take advantage of the particular flow pattern of the fuel/air mixture therein to provide improved combustion. Moreover, the number, size and configuration of the electrode apertures 41,47 and electrode legs 49 can be varied for a particular combustion chamber geometry to this end. The orientation and configuration of the ground electrode 30 will depend on the particular combustion chamber geometry employed and may vary from cylinder to cylinder of the engine.

Since the ground electrode 30 is permanently affixed to the cylinder head 10, the ground electrode 30 is intended to be in service in the internal combustion engine for a long time period, preferably for the service life of the engine. To this end, the permanent ground electrode 30 is made of a heat-resistant metal, such as INCONEL 600, tungsten, stainless steel, precious metal coated metal substrate and the like, that exhibits appropriate heat resistance and strength for such long term use in the engine. The cylinder head 10 ordinarily will be made of cast aluminum or cast iron.

Although the permanent ground electrode 30 is described hereinabove as having the peripheral wall 40 at least partially closed in the combustion chamber 18 by the end closure 46 to form a cage-like or cup-like ground electrode 30, the present invention is not so limited. In particular, the invention also envisions a tubular ground electrode (not shown) having open inner and outer ends (e.g., a ground electrode similar to that shown in FIGS. 1–5 but without the end closure 46 partially closing off the inner end of the peripheral wall 40). Moreover, other ground electrode configurations are within the scope of the invention. For example, a ground electrode having a U-shaped transverse cross-section may be useful in practicing the invention. In general, the configuration and mass of the ground electrode will depend upon the particular combustion chamber geometry employed, the severity of the service application in the engine and the heat resistance/-strength of the material from which the ground electrode is made.

In accordance with the invention, a center electrode element 60 is replaceably received in the cylinder head bore 20 through the cylinder head outer wall 14. The center electrode element 60 comprises an axially elongated center electrode 61 and an axially elongated insulator (dielectric) body 62 surrounding the center electrode 61. The center electrode 61 includes an inner metallic portion 64 having an inner end tip 66, an outer metallic portion 68 having an end 70 configured to engage a conventional spark plug lead wire boot (not shown) in known manner, and an intermediate resistor glass seal 72 of the type generally known in the spark plug industry to provide gas sealing.

The axially elongated insulator body 62 is formed integrally about the center electrode 61 and includes a first inner annular shoulder 76 for engaging the annular seat 32 of the cylinder head bore 20 and a second outer annular shoulder 78 axially spaced apart from the first shoulder 76 for cooperation with locking means 80 and spring means 90 to be described hereinbelow.

Those skilled in the art will appreciate that the center electrode element 60 does not include an outer metal (e.g., steel) shell of the type present on a conventional spark plug. Thus, the center electrode element 60 is considered shell-less from this standpoint and provides benefits to be explained hereinbelow.

The locking means 80 referred to hereinabove preferably comprises an annular, spanner retainer nut 82, shown in FIGS. 1–2. The spanner retainer nut 82 includes an annular metal (e.g., steel, aluminum, copper, etc.) body 84 having an outer threaded periphery 84*a* and an inner bore 86 to receive the insulator body 62. The inner bore 86 includes an annular shoulder 88 that is axially spaced from the annular outer shoulder 78 of the insulator body 62 to accommodate the spring means 90 in the form of one or more Bellville spring washers 92 therebetween. The outer end of the retainer nut 82 includes four radial slots 93 arranged in diametrically opposed pairs. Alternately, a single pair of diametrically opposed slots may suitably be used. In any event, the slots 93 are configured and circumferentially spaced apart about the retainer nut 82, FIG. 2, so as to be engageable by a conventional spanner wrench (not shown) for installation and removal of the center electrode element 60 in the cylinder head bore 20.

The replaceable center electrode element 60 is installed in the cylinder head bore 20 simply by inserting it therein until the inner insulator body shoulder 76 engages the seat 32 of the bore 30, FIG. 1. Then, the spanner retainer nut 82 is threaded into the outer, threaded bore portion 24 to clamp the spring washers 92 between the retainer nut shoulder 88 and the outer insulator body shoulder 78. As the retainer nut 82 is tightened, the inner insulator body shoulder 76 is sealingly clamped against the bore seat 32. This clamping action places the insulator body 62 in intimate thermal conductive contact with the cylinder head 10 to provide a path for heat transfer from the insulator body 62. This clamping action also secures the center electrode element 60 in the cylinder head bore 20 in such a manner that the center electrode tip 66 is received in the electrode-receiving hollow 44 defined by permanent ground electrode 30, FIG. 1, so as to cooperate therewith in defining a spark gap G therebetween.

The spring washers 92 are provided between shoulders 78,88 to compensate for thermal expansion coefficient differences between the cylinder head 10 and the center electrode insulator body 62. In particular, during engine operation at elevated temperature, the spring washers 92 maintain a bias on the insulator body 62 toward the bore seat 32 to provide required heat transfer and gas sealing therebetween. Use of the spring washers 92 is particularly advantageous when the cylinder head 10 comprises aluminum. In the event the cylinder head 10 comprises iron (which exhibits a lower thermal expansion coefficient and higher yield strength than aluminum), the spring washers 92 may be replaced by a conventional sealing gasket (not shown) of copper, steel and the like.

Figure 6:
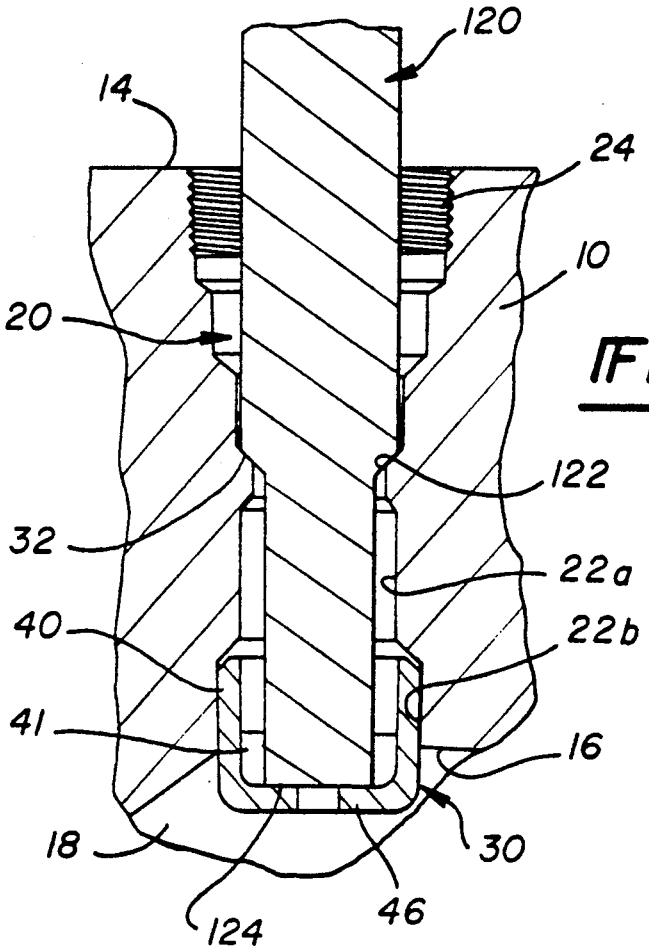
FIG. 6 is a longitudinal cross-sectional view of a portion of an internal combustion engine cylinder head showing the ground electrode permanently affixed in the cylinder head bore and a mandrel inserted axially in the cylinder head bore to engage a mandrel end and the ground electrode closed end.

In accordance with a particular method aspect of the present invention illustrated in FIG. 6, after the ground electrode 30 is permanently affixed to the cylinder head 10 in the cylinder head bore 20 but prior to installation of the center electrode element 60, a precision mandrel 120 is inserted axially into the bore 20 through the cylinder head outer wall 14. The mandrel 120 is inserted in the bore 20 until an annular mandrel shoulder 122 abuts the bore seat 32. This abutment places a working end 124 of the mandrel 120 in a preselected axial relation to the bore seat 32 as determined by the fixed axial distance between the mandrel shoulder 122 and mandrel end 124.

As the mandrel 120 is inserted in the cylinder head bore 20 in this manner, the ground electrode end closure 46 may be worked by the mandrel end 124 to position the end closure 46 in a desired preselected axial relation to the seat 32 as determined by the axial distance between the mandrel shoulder 122 and the mandrel end 124. In the event the ground electrode end closure 46 is too close to the cylinder head inner wall 16, the end closure 46 is engaged by the mandrel end 124 and deformed axially away from the cylinder head inner wall 16 as the mandrel 120 is inserted in the bore 20 until shoulder 122 abuts seat 32. In the event the ground electrode end closure 46 is too far away from the cylinder head inner wall 16, the end closure 46 is deformed axially toward and against the mandrel end 124 using a suitable tool (not shown) such as a hammer. A preselected axial relation is thereby established between the ground electrode end closure 46 and the bore seat 32 prior to insertion of the center electrode element 60 in the cylinder head bore 20. Thereafter, the mandrel 120 is removed from the cylinder head bore 20 and the center electrode element 60 is installed and secured in the cylinder head bore 20 as described hereinabove.

Use of the shell-less center electrode element 60 in conjunction with the spanner retainer nut 82 to secure the center electrode element 60 in the cylinder head bore 20 frees substantial space on the cylinder head 12 to accommodate other engine components such as intake/exhaust valve, intake/exhaust passages, cam shafts and water jacketing used, or proposed for use, by manufacturers for fuel efficient and/or high performance engines. Moreover, the clearance space required for the center electrode element installation/removal tool (i.e., a spanner wrench in lieu of a hexagonal drive socket) is also reduced. In addition, the size (e.g., diameter) of the center electrode insulator body 62 may be reduced this same end.

Importantly, these space-saving benefits are obtained while providing a predetermined, controlled orientation of the permanent ground electrode 30 relative to the geometry of the combustion chamber 18 as described hereinabove.

Moreover, these benefits are obtainable without compromising the performance of the ground electrode 30 and center electrode element 60 in terms of leakage, dielectric strength, mechanical strength, fouling resistance, idle stability and electrode life. In particular, the present invention provides performance characteristics equal to or better than a conventional "shelled" spark plug while requiring significantly less space on the cylinder head 12.

While the invention has been described in terms of specific embodiments thereof, it is not intended to be limited thereto but rather only to the extent set forth hereafter in the claims.

The embodiments of the invention in which an exclusive property or privilege is claimed are defined as follows:

1. An internal combustion engine comprising: (a) a cylinder head having an outer wall, an inner wall forming at least a portion of a combustion chamber, a spark plug bore extending between the outer and inner walls along an axis and including an intermediate transverse seat for engaging an element introduced through the outer wall against movement toward the inner wall, (b) a permanent ground electrode permanently affixed to the cylinder head at the inner wall proximate to the bore, (c) a spark plug center electrode element replaceably received in the bore through the outer wall and comprising a center electrode and a surrounding insulator body having a shoulder engaging the bore seat, said center electrode extending within the combustion chamber spaced apart from the ground electrode so as to cooperate therewith to define a spark gap, and (d) locking means removably attached to the cylinder head for clamping the insulator body against the bore seat to secure the center electrode element in the cylinder head bore in spark generating arrangement with the ground electrode.

2. The internal combustion engine of claim 1 wherein the ground electrode has a cup-like configuration and comprises a peripheral wall and an end wall that cooperate to define a center electrode-receiving hollow, at least a portion of said peripheral wall being received in said bore through the inner wall for attachment to said cylinder head such that said end wall protrudes into the combustion chamber, said ground electrode further comprising openings for communication of said hollow with said combustion chamber.

3. The engine of claim 1 wherein the locking means comprises an annular spanner retainer nut threadably received in a threaded portion of the cylinder head bore about the insulator body to clamp the insulator body shoulder against the bore seat.

4. The engine of claim 3 further comprising spring means disposed between the retainer nut and the insulator body for biasing the insulator body shoulder against the bore seat.

5. The engine of claim 2 wherein an axial portion of the permanent ground electrode is press fit in the cylinder head bore.

6. The engine of claim 2 wherein the cylinder head comprises a metal casting that is solidified about an axial portion of the ground electrode to affix it to said cylinder head.

7. The engine of claim 1 wherein the cylinder head is formed of an aluminum or iron casting and the permanent ground electrode is composed of a refractory metal distinct from the cylinder head.

8. The engine of claim 7 wherein the permanent ground electrode is composed of a nickel-base metal.

9. A method of manufacturing a ground electrode for use with a spark plug center electrode element installed in a cylinder head of an internal combustion engine, said cylinder head having an outer wall, an inner wall forming at least a portion of a combustion chamber, and a bore for receiving the spark plug element between the outer and inner walls along an axis, said bore including an intermediate transverse seat for engaging a shoulder of the center electrode element installed through the outer wall against movement toward the inner wall, said method comprising the steps of:

(a) forming a ground electrode comprising a peripheral wall, a first, open end and a second, at least partially closed end, (b) permanently affixing the ground electrode in the cylinder head bore such that said peripheral wall is partially received in the cylinder head bore through the cylinder head inner wall and the closed end is disposed beyond the cylinder head inner wall for protruding into the combustion chamber, said ground electrode open end being in registration with said bore, (c) axially inserting a mandrel in the bore through the cylinder head outer wall, said mandrel having an end for engaging the ground electrode closed end, (d) working the ground electrode closed end against the mandrel end to position said end in a preselected axial relation to the seat, and (e) removing the mandrel.

10. The method of claim 9 wherein the permanent ground electrode is affixed to the cylinder head by press fitting an axial portion of the ground electrode in the cylinder head bore.

11. The method of claim 9 wherein the permanent ground electrode is affixed to the cylinder head by casting the cylinder head about an axial portion of the ground electrode to capture the ground electrode in the cylinder head bore.

* * * * *